US008601956B2

(12) United States Patent
Ceballos-Godefroy

(10) Patent No.: US 8,601,956 B2
(45) Date of Patent: Dec. 10, 2013

(54) FOLDING DISPLAY AND WORK FURNITURE ITEM

(76) Inventor: Ricardo Ceballos-Godefroy, Col. Del Valle (MX)

( * ) Notice: Subject to any disclaimer, the term of this patent is extended or adjusted under 35 U.S.C. 154(b) by 611 days.

(21) Appl. No.: 12/598,139

(22) PCT Filed: Jul. 10, 2008

(86) PCT No.: PCT/IB2008/001807

§ 371 (c)(1),
(2), (4) Date: May 5, 2010

(87) PCT Pub. No.: WO2009/106913

PCT Pub. Date: Sep. 3, 2009

(65) Prior Publication Data

US 2010/0213801 A1 Aug. 26, 2010

(30) Foreign Application Priority Data

Feb. 29, 2008 (MX) ..... MX/a/2008/002971

(51) Int. Cl.
*A47B 3/083* (2006.01)

(52) U.S. Cl.
USPC ..... 108/170; 108/99; 108/134; 108/50.02; 108/177

(58) Field of Classification Search
USPC ..... 108/115, 134, 99, 166, 167, 171, 175, 108/170, 48, 50.02, 177; 312/258, 223.6, 312/245, 262, 314, 282, 313, 317.1, 317.3; 297/17, 183.1, 183.5; 16/365, 324, 326
See application file for complete search history.

(56) References Cited

U.S. PATENT DOCUMENTS

| | | | | |
|---|---|---|---|---|
| 2,222,318 | A | 11/1940 | McLauthlin et al. | |
| 2,932,343 | A * | 4/1960 | La Brut | 312/262 |
| 4,155,609 | A * | 5/1979 | Skafte et al. | 312/245 |
| 4,740,010 | A * | 4/1988 | Moskovitz | 280/641 |
| 5,085,608 | A * | 2/1992 | Turner | 446/75 |
| 5,095,642 | A * | 3/1992 | George et al. | 40/610 |
| 5,277,005 | A | 1/1994 | Hellwig et al. | |
| 5,666,765 | A * | 9/1997 | Sarner et al. | 52/36.1 |
| 6,578,708 | B2 * | 6/2003 | Barnett | 206/320 |
| 6,811,233 | B1 * | 11/2004 | Packer | 312/313 |
| 6,926,155 | B2 * | 8/2005 | Vogel | 209/554 |
| 7,246,556 | B1 * | 7/2007 | Stoneberg et al. | 101/333 |
| D598,671 | S * | 8/2009 | Gagnon, Jr. | D6/430 |
| 7,635,052 | B2 | 12/2009 | Ceballos-Godefroy et al. | |
| 2004/0238469 | A1 * | 12/2004 | Ng | 211/149 |
| 2007/0068428 | A1 * | 3/2007 | Liao | 108/59 |

FOREIGN PATENT DOCUMENTS

| | | |
|---|---|---|
| DE | 20018744 U1 | 2/2001 |
| EP | 0575275 A1 | 12/1993 |

(Continued)

*Primary Examiner* — Darnell Jayne
*Assistant Examiner* — Andres F Gallego
(74) *Attorney, Agent, or Firm* — Browdy and Neimark, PLLC

(57) ABSTRACT

A foldable exhibition and working furniture includes a lower wall hingedly attached to an upper wall, both walls form a housing when the exhibition furniture is folded. In the furniture, a side wall is laterally spaced from the lower wall but connected by a foldable shelf, a foldable support holding the shelf and a cover hingedly attached to the lower wall and detachably joined on the side wall. To fold the exhibition furniture, the cover is detached from the side wall, this approaches towards the lower wall thereby automatically folding the foldable support and the shelf, the cover is lowered to cover the side wall and finally the upper wall is lowered to be coupled with the lower wall then forming the housing.

18 Claims, 14 Drawing Sheets

(56) References Cited

FOREIGN PATENT DOCUMENTS

| | | | |
|---|---|---|---|
| FR | 2720720 | A1 | 12/1995 |
| GB | 2369040 | A | 5/2002 |
| WO | 2006036226 | A2 | 4/2006 |
| WO | 2006136874 | A1 | 12/2006 |
| WO | 2007148963 | A2 | 12/2007 |
| WO | 2008062286 | A2 | 5/2008 |

* cited by examiner

FOLDING DISPLAY AND WORK FURNITURE ITEM

FIELD OF THE INVENTION

The present invention relates to the techniques employed in the manufacture and design of furniture, displays and counters used in locations referred to as "points of sale", where products and services are offered to the public, and more particularly, it relates to a foldable exhibition and working furniture.

BACKGROUND OF THE INVENTION

In different places where public converge for the acquisition and diffusion of products and services, such as exhibitions, conventions, information centers, and so on, the use of furniture and displays is necessary such that people can contact suppliers and get to know their products. In this regard, a great variety of these pieces of furniture is available and built in wood, metal, with shelves and partitions; however, in general terms, they are bulky, difficult to handle, and their transportation results a hard work as they take up too much space.

A known solution in the prior art has been the creation of foldable furniture and displays made from cardboard. Nevertheless, their poor structural rigidity is a drawback, such that items of considerable weight cannot be placed thereon, and furthermore, it is impossible for the vendor to lean on such furniture. One example of a cardboard display is described in the European patent application No. EP 0 575 275 A1, incorporated herein by reference. In addition, this type of cardboard furniture lacks a remarkable aesthetic appearance, which is an important factor in order to achieve a commercial impact for the product or service being offered.

There are also furniture having an infinity of panels, rods and posts attached to each other, nevertheless, the assembling thereof is a time consuming task due to the great number of pieces to be assembled.

However, there is furniture that is well accepted and very practical to be used for such purposes, as those displays comprising a base, a cover over the base and a board located above the cover. In this type of displays, the board is used to identify the supplier's name or the product being offered, while the supplier is located behind the module to attend to the approaching clients.

One of these displays is disclosed in the Mexican Patent No. 212,227, wherein the most important advantage is the module elements detach and store in the form of a portfolio. In the module of this patent, inside the base a hinged shelf is included. However, a drawback in said module is the movement of the shelf and post sections holding the board within the base when stored therein. Further, when the module is assembled, the posts and board have a poor stability, moreover, the pins used to close the cover are external and, therefore, are a point prone to fail.

In the Mexican Patent No. 225,710, the module of the above mentioned patent was restructured, wherein, the most important changes are the inclusion of cuts at 45° between the post sections and a second shelf running over a rail. In addition, a support to keep fixed the post sections inside the second shelf was included. Notwithstanding this change, the board again has instability, since it balances over the cover, further, the shelves often fall from their horizontal position, since in their free side ends, the shelves are subject to pressure between the base side panels only. Moreover, the cover (portfolio body) has strength problems when the module to be stored therein, particularly, the cover is prone to breaking when handling and transporting. More specifically, when the cover is struck at its inner part, the transmission of the impact through the side walls to the lid has been seen, breaking said lid.

The forming of scratches over the base panels each time this is taken out or in the cover is another problem having been noticed. Moreover, when the base is within the cover, a movement of the base from the top to the bottom has been noticed, thereby damaging the cover.

In order to solve the above mentioned problems of the Mexican Patents No. 212,227, and No. 225,710 modules, the module has been improved as disclosed in the International Patent Application No. PCT/IB2005/002083; in this application, means to support the shelves in place are proposed, further firmly fastening these when the module is collapsed, i.e., the shelves do not move when the module is transported as a portfolio. Moreover, one of the shelves is slidable to be easily located in the horizontal position when the module is being assembled. In addition, modifications improving the cover strength are incorporated, such cover serves as the case to store the base with the board and the posts therein.

It is worth to mention that these type of modules stored in a portfolio form are commercially available at the Mexican market under the trademark Quick Counter®.

Now then, this module meets the needs for the services and products offered in "points of sales" since it is very solid. However, a drawback is that it has to be hold to be transported, and although there are not many pieces to be assembled, it is necessary to couple and decouple pieces, mainly at the board section, to raise the furniture. Further, to hingedly attach the module base panels, aluminum hinges are used, increasing its weight which is of about 13 kg.

Another foldable furniture is described in the International Patent Application No. PCT/IB2007/003578 (U.S. application Ser. No. 12/516,338), which inventor is the same as that for the present invention. Particularly, said application describes a collapsible service cart, having the advantage of housing its pieces between the side walls thereof, however, among the cart pieces there are doors and a board required to be handled by the user to be fixed and coupled in their corresponding place.

Summarizing, the need for light, easy assembling and portable exhibition furniture is always present. Further, in many occasions is desirable for the furniture to have sockets, since people working on the furniture frequently use electric apparatuses or devices.

SUMMARY OF THE INVENTION

To overcome the design drawbacks of the furniture used in points of sales, a folding exhibition and working furniture has been designed, requiring a minimum of time and effort to be assembled from a "folding" position to an "upright" position, this because the furniture of the present invention has its own structure with few pieces to be assembled.

Particularly, the furniture of the present invention comprises: a lower wall; an upper wall hingedly attached to the lower wall and extending upward thereof when the exhibition and working furniture is at the upright position. In this regard, when the exhibition furniture is folded, both the lower wall and the upper wall together form a housing, to house the remaining furniture elements described below.

Among said additional furniture elements, there is a side wall laterally spaced apart from the lower wall; a shelf comprising a first half and a second half hingedly attached to each other, wherein the first half is hingedly attached to the lower wall and the second half is attached to the side wall. In order to support the foldable shelf, another furniture element is a foldable support hingedly attached to both the lower wall and the side wall, the foldable support contacts the shelf to give support from below thereof. In this manner, the shelf and foldable support connect the lower wall to the side wall.

A cover is another element connecting the lower wall to the side wall, said cover is hingedly attached to the lower wall and detachably joined over the side wall.

To fold the exhibition furniture, the cover is detached from the side wall, which approaches towards the lower wall thus automatically folding the foldable support and the shelf to be covered both by the side wall; then, the cover is lowered to cover the side wall and finally, the upper wall is lowered to be coupled with the lower wall to form a housing thereby achieving the furniture folded position.

In a preferred embodiment, the display furniture includes casters mounted in the lower wall, contacting the floor, to move the exhibition furniture either when in the folded or the upright position. In an alternative embodiment, the furniture has a foldable front wall attached to the cover, such that when the exhibition furniture is in the upright position, the front wall extends from the cover downwards covering the shelf; further, the front wall is releasable fixed to the side wall and to said shelf, the front wall folds and houses underneath the cover. In a specific embodiment, the furniture has a socket located at the lower wall in order that electrical devices may be used inside the furniture.

BRIEF DESCRIPTION OF THE DRAWINGS

The novel aspects deemed as unique to the present invention will be specifically set forth in the appended claims. Nevertheless, the structure, the way of raising and folding the furniture, along with other objects and advantages of the present invention, will be better understood in the following detailed description of a preferred embodiment, when read in conjunction with the accompanying drawings, wherein:

DETAILED DESCRIPTION OF THE PREFERRED EMBODIMENT OF THE INVENTION

Figure 1:
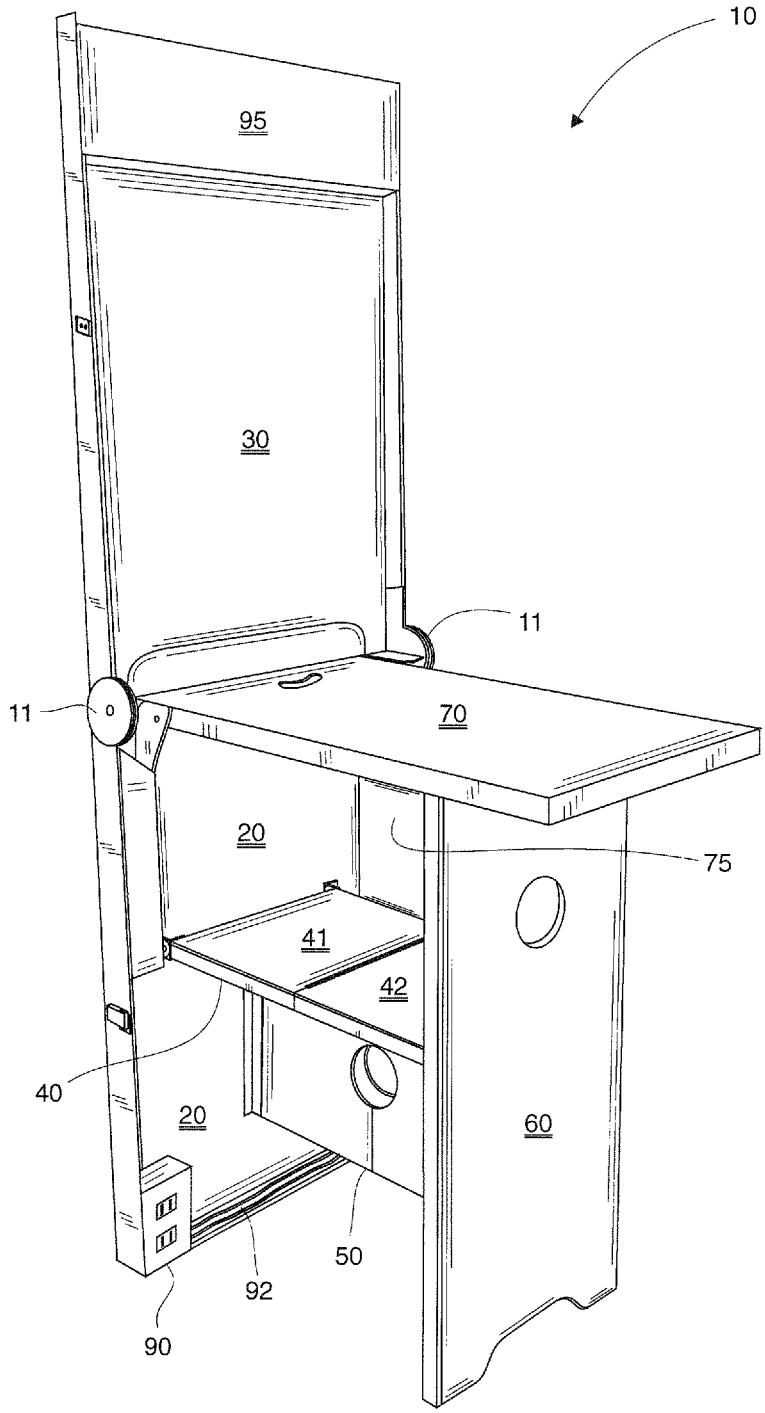
FIG. 1 is a back perspective view of a foldable exhibition and working furniture constructed according to a preferred embodiment of the present invention.

With reference to the accompanying drawings, and more specifically to FIGS. 1 to 4, a foldable exhibition and working furniture 10 is shown in the "upright" position, the furniture 10 is constructed according to one preferred embodiment of the present invention, which shall be considered only as illustrative and not limitative thereof. The foldable exhibition and working furniture 10 comprises a lower wall 20 to which an upper wall 30 is hingedly attached by a pair of hinges 11 laterally opposite one to the other. As can be seen, the upper wall 30 extends upwards from the lower wall 20 such as if both walls 20 and 30 were a single wall. In a certain manner, the lower wall 20 and the upper wall 30 are the most important elements of the exhibition and working furniture 10, since they form a housing when the exhibition and working furniture 10 is folded, as will be described and illustrated below.

Referring to FIGS. 1 to 5, FIGS. 1 and 3 show a shelf 40 inside the furniture, which shelf comprises a first half 41 and a second half 42 hingedly attached to each other. Said first half 41 is hingedly attached to the lower wall 20, while said second half 42 is hingedly attached to a side wall 60. Regarding the shelf 40, in order to provide support to the same, the furniture 10 has a foldable support 50 hingedly attached to the lower wall 20 and to the side wall 60, this foldable support 50 contacts the shelf 40 and supports it from below thereof. The structure of the foldable support will be described below.

The lateral wall 60 can be clearly appreciated in FIGS. 1 to 4, which, as mentioned above, is hingedly attached to the second half 42 of the shelf 40 and the foldable support 50. Finally, in this FIGS. 1 to 4 is shown a cover 70, which is hingedly attached to the lower wall 20 and detachably joined over the lateral wall 60 such that it connects the lateral wall to the lower wall 20 thus providing stability to the furniture 10.

In the embodiment being described, the cover includes as an optional element a foldable front wall 75 hingedly attached thereto, which is folded and housed inside the cover 70. When the exhibition furniture 10 is at the upright position such as shown in FIGS. 1 to 4, the front wall 75 extends from the cover 70 downwards hiding the shelf 40 from the furniture 10 front part. In this respect, when the furniture 10 is at the upright position, the front wall 75 is attached to the lateral wall 60 and to the shelf 40 by hook and fiber cooperating portions 81 (Velcro®) provided at the front wall 75, the side wall 60 and the shelf 40. The hook and fiber cooperating portions 81 are illustrated with dashed lines in FIGS. 2 and 4.

Figure 3:
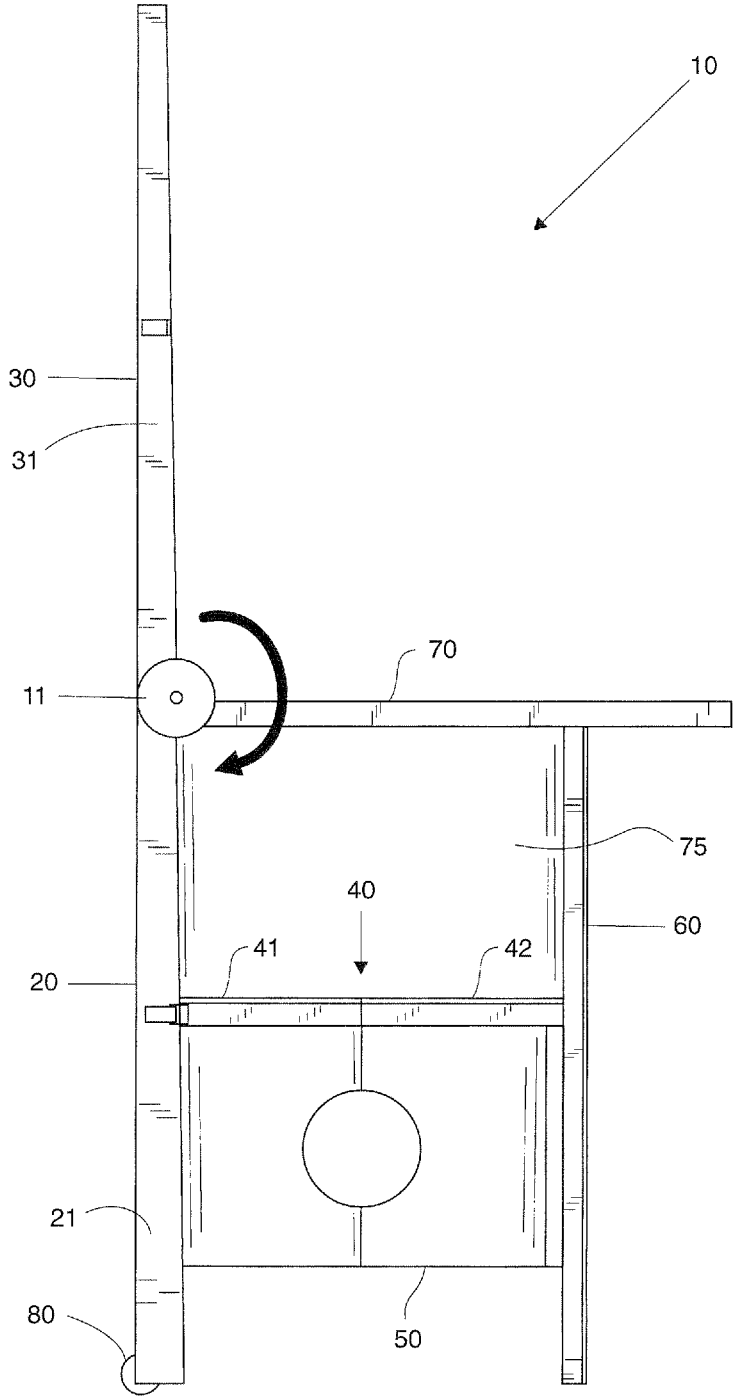
FIG. 3 is a back view of the foldable exhibition and working furniture of FIG. 1.
Figure 4:
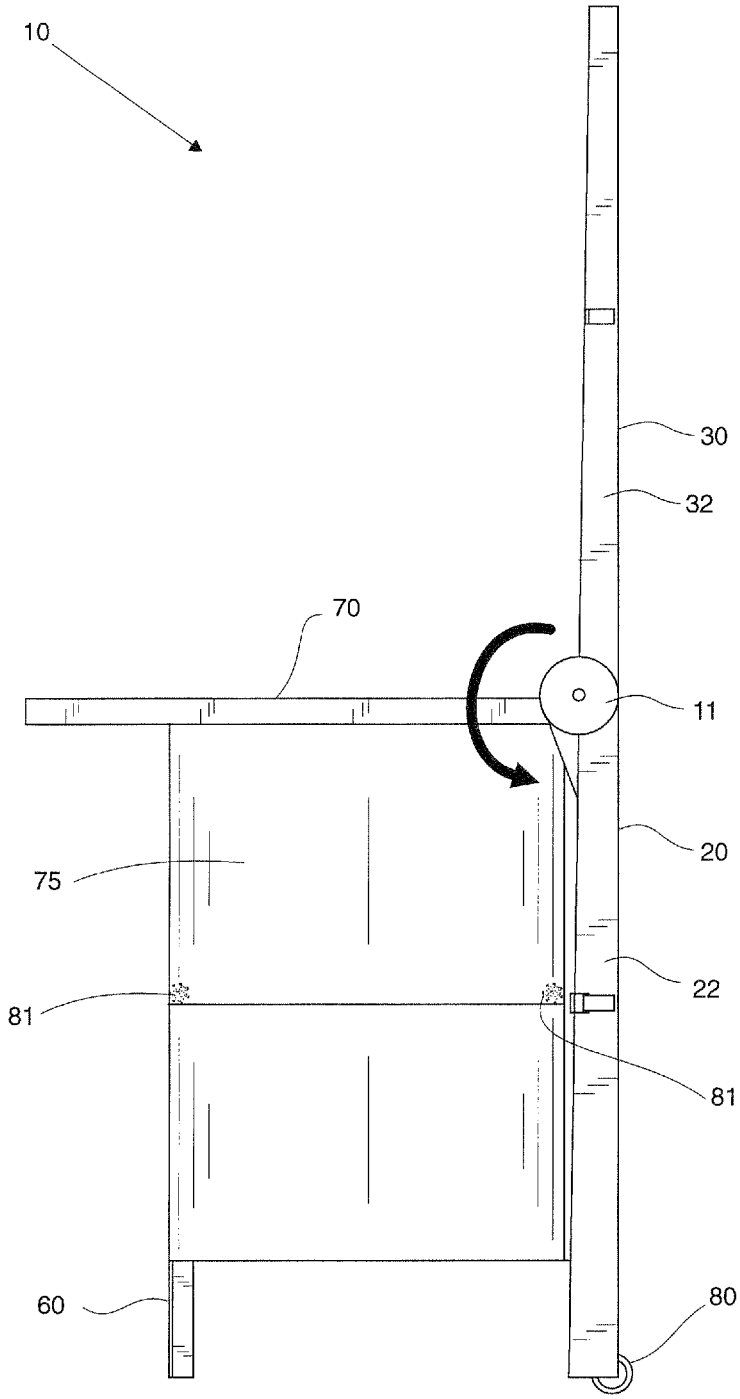
FIG. 4 is a front view of the foldable exhibition and working furniture of FIG. 1.
Figure 5:
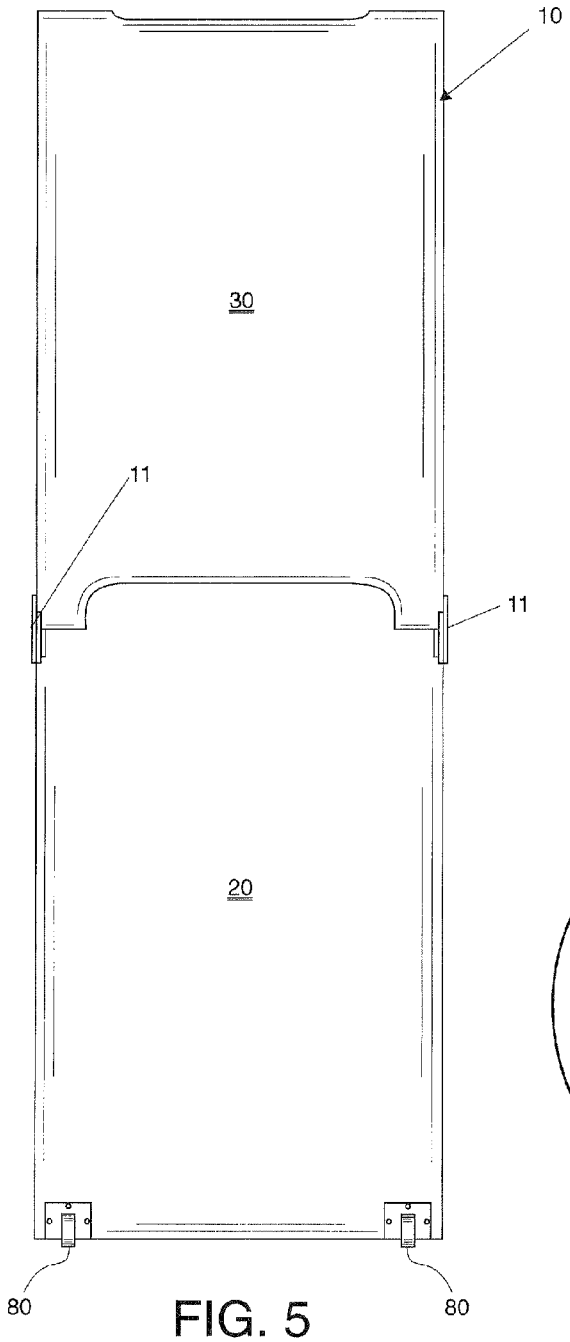
FIG. 5 is a left side view of the foldable exhibition and working furniture of FIG. 1.

Particularly referring to FIGS. 3 to 5, the furniture 10 of the preferred embodiment is shown, having casters 80 mounted in the lower wall 20 and contacting the floor in order to easily move the exhibition furniture when in the folded or upright position. The exhibition furniture 10 as shown in FIGS. 3 to 5 is supported on the floor by said casters 80 and the side wall lower edge 60. Casters 80 are optional for the present invention, however, they are very useful to easily move the furniture 10 from one place to another.

Turning to FIG. 1 the lower wall 20 can be seen, provided with a socket 90 located at a lower corner of the lower wall 20 which aids to work with an electrical apparatus or device inside the furniture 10. The socket 90 receives electric power supply from any source by means of a feed cable 92 stored in a compartment 91 provided at the opposite lower corner with respect to the corner having the socket 90; the compartment 91 can be clearly appreciated in FIG. 2.

Figure 2:
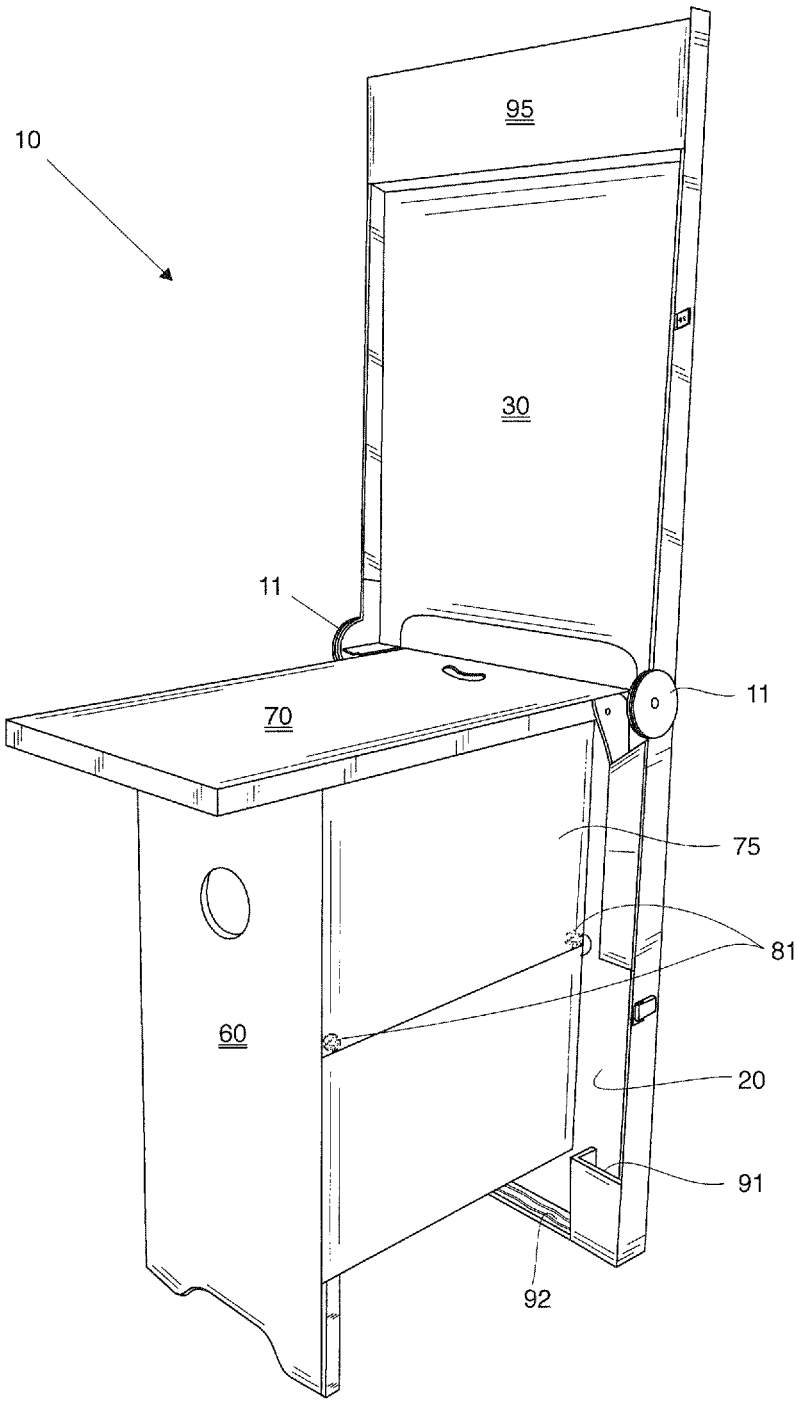
FIG. 2 is a front perspective view of the foldable exhibition and working furniture of FIG. 1.

Another optional element of the furniture of the present invention specifically shown in FIGS. 1 and 2 is a board 95 included in the upper wall 30 particularly, the board 95 is located at the wall upper part 30. Over said board 95, graphic material can be placed on to identify the vendor using the furniture 10, particularly the board 95 is embedded in the upper wall 30.

As mentioned above, the two elements having a very important role in the present invention are the lower wall 20 and the upper wall 30, since both form a housing and they are hingedly attached by means of hinges 11. Both walls 20 and 30 having a pair of opposite side faces identified as references 21, 22 and 31 and 32, respectively, can be seen in FIGS. 3 and 4. The width of the side walls 31 and 32 of the upper wall 30 increases from the top to the bottom as noted in FIGS. 3 and 4. In the same manner, the width of the side faces 21 and 22 of the lower wall 20 also increases from the top to the bottom, and it is always higher than the width of the side faces 31 and 32 of the upper wall 30, this feature regarding the width of the lower and upper wall 20 and 30 side faces has two objects. The first is to make the upper wall 30 a counterpart wherein its side faces 31 and 32 edges contact the respective side faces 21 and 22 edges of the lower wall 20, thus forming a housing as the upper wall 30 moves downwards supported on the hinges 11. The second object is to achieve the lowest width as possible for the furniture 10, to house the other elements thereof extending from the lower wall 20 and the upper wall 30. Every wall is preferably formed of a single plate from foamed PVC, bended at its edges to form the side faces 21, 22, 31 or 32.

On the other hand, referring to FIG. 5, it is important to take care on the stability and firm position of the furniture 10 of the present invention when in the upright position, i.e., the upper wall 30 must not descend towards the lower wall 20. For this purpose in the embodiment being described locking means are provided, which actuate on the hinges 11 through which said walls 20 and 30 are joined together.

Figure 6:
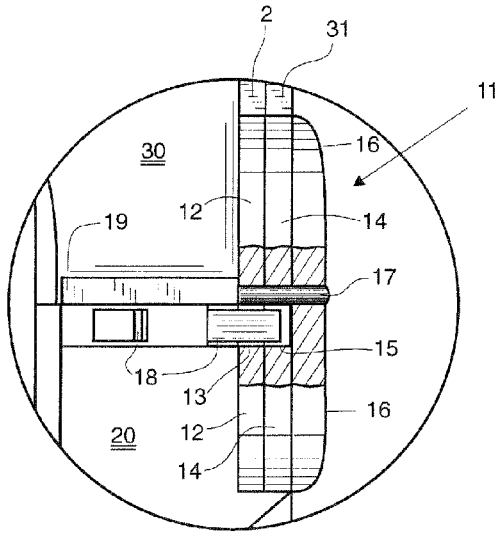
FIG. 6 is a fragmented right side view of one hinge joining the lower wall to the upper wall.

To explain the actuation of the locking means for the embodiment being described, the construction of the hinge 11 will be described referring to FIG. 6 showing an enlarged right side view of a hinge 11, wherein a part of the hinge 11 has been removed to clearly appreciate certain elements being designed and located inside thereof. The view in FIG. 6 is opposite to the side view of FIG. 5. In FIG. 6, the hinge 11 comprises: a first disk 12 attached to the upper part 30, preferably by a tab 2 projecting upwards the disk 12 and attached to the side face 32; the first disk 12 further includes a first locking groove 13. The hinge 11 also has as additional pieces a disk 14 located next to the first disk 12 and preferably integrally attached to the lower wall 20, this second disk 14 includes a second locking groove 15. Another part of the hinge 11 is a base disk 16 located next to the second disk 14, such that the second disk 14 is between the first disk 12 and the base disk 16; and, finally all disks 12, 14 and 16 are crossed by a rotating axis 17 such that the first disk 12 may move around the rotating axis 17 to move the upper wall 30 upwards or downwards over the lower wall 20, supported on the hinge 11.

To lock or block said hinge 11 movement, as locking means the pin 18 is used, which is attached on the lower wall 20 and being received inside the first and second grooves 13 and 15. When the pin is inside said grooves 13 and 15, the rotation movement of the first disk 12 around the rotation axis 17 is prevented, consequently the upper wall 30 cannot be lowered or descended. On the other part, to keep the pin 18 out of sight and prevent an accidental movement thereof, a safety plate 19 is provided, arranged in an horizontal position and extending from the side face 32 and near the lower end of the upper wall 30 to cover the pin 18; the safety plate is integrally formed in the upper wall. The hinge 11 at the left side of the furniture 10 has the same construction.

Figure 7:
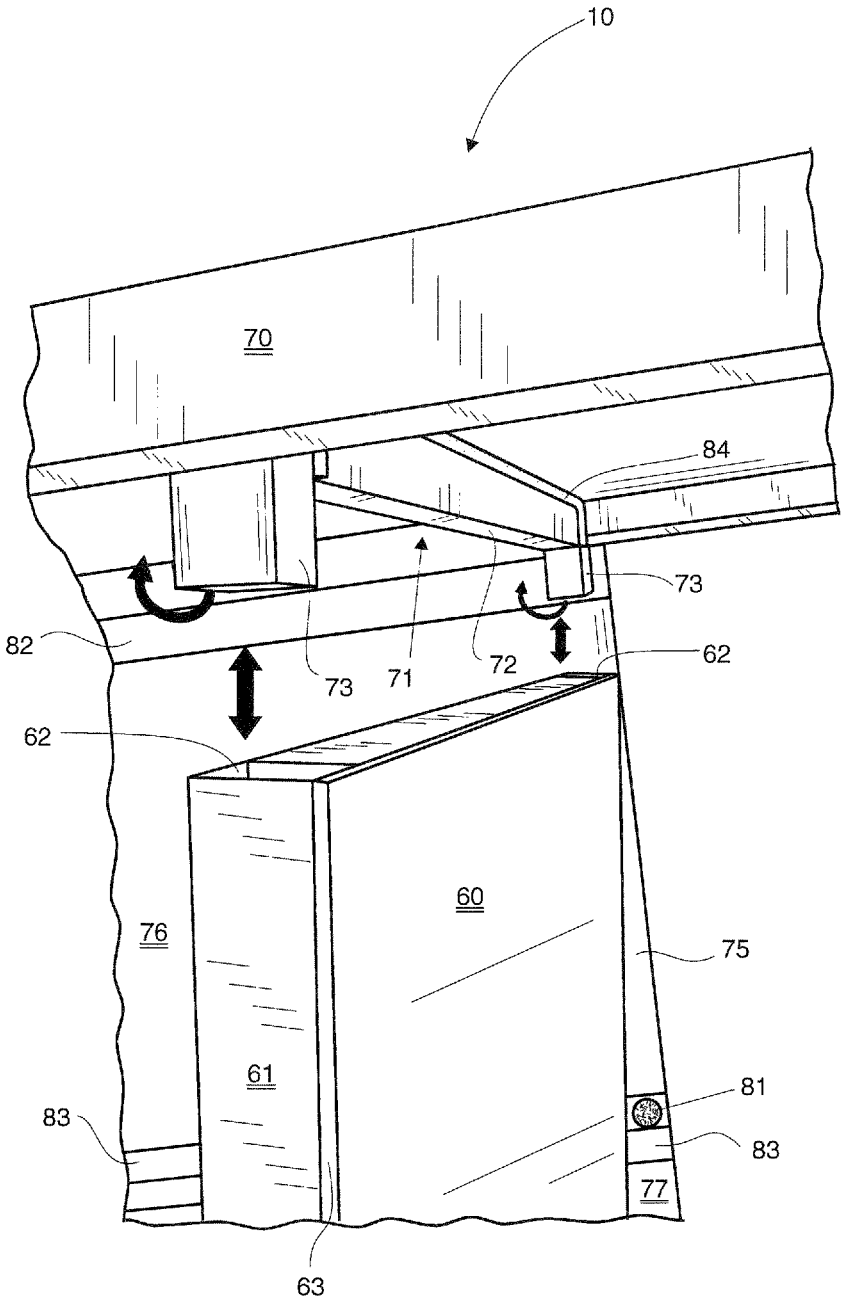
FIG. 7 is a lower back perspective view showing the cover and side wall decoupling for the exhibition furniture of FIG. 1.

Once the arrangement of the furniture elements as well as their securing when in an upright position have been described, now the manner how they are folded will be indicated, with reference to FIG. 7 showing an enlarged lower perspective view of the cover 70 and the side wall 60. When the furniture is at the upright position, the cover 70 is detachably joined to the side wall 60, by a coupling 71 provided at the cover lower part, and received inside the side wall 60. In a particular manner, the coupling 71 comprises a transversal profile 72 hingedly attached to the cover 70 and a pair of coupling projections 73 attached to the transversal profile ends 72 and received in the side wall 60. Particularly, the coupling ends 73 are received in a frame 61 with upper openings 62. Removing the coupling projections 73 from the upper openings 62, the cover decoupling and releasing from the side wall 60 is achieved, however, the hook and fiber cooperating portions 81 provided at the front wall 75, the side wall 60 and the shelf (not shown in FIG. 7) are previously detached. It is to be mentioned that besides to said frame 61, the side wall 60 is formed by a plate 63 attached to and covering said frame 61. The cover 70 is preferably formed of a single plate made from foamed PVC.

Figure 8:
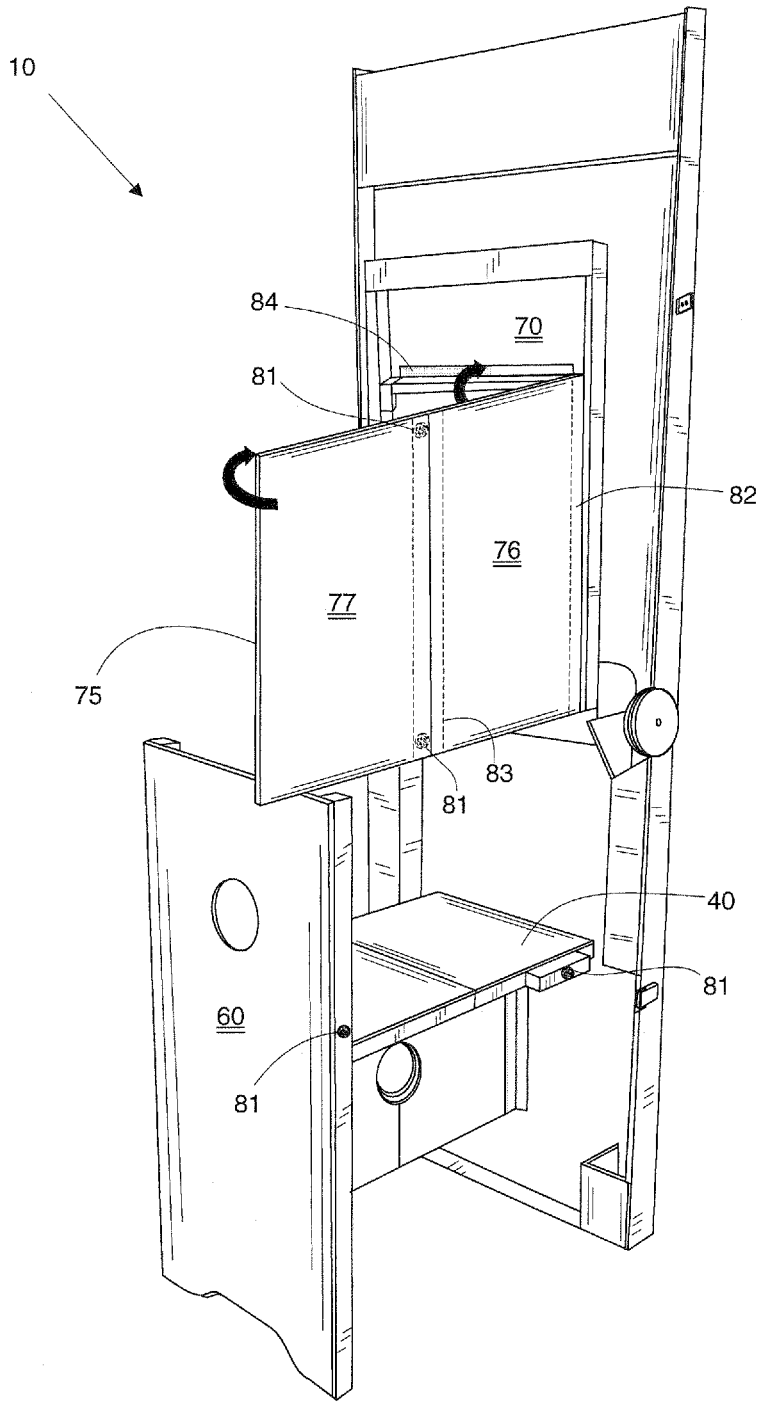
FIG. 8 is a front perspective view of the exhibition furniture of FIG. 2 showing the cover already decoupled and the front wall thereof ready to be folded.
Figure 9:
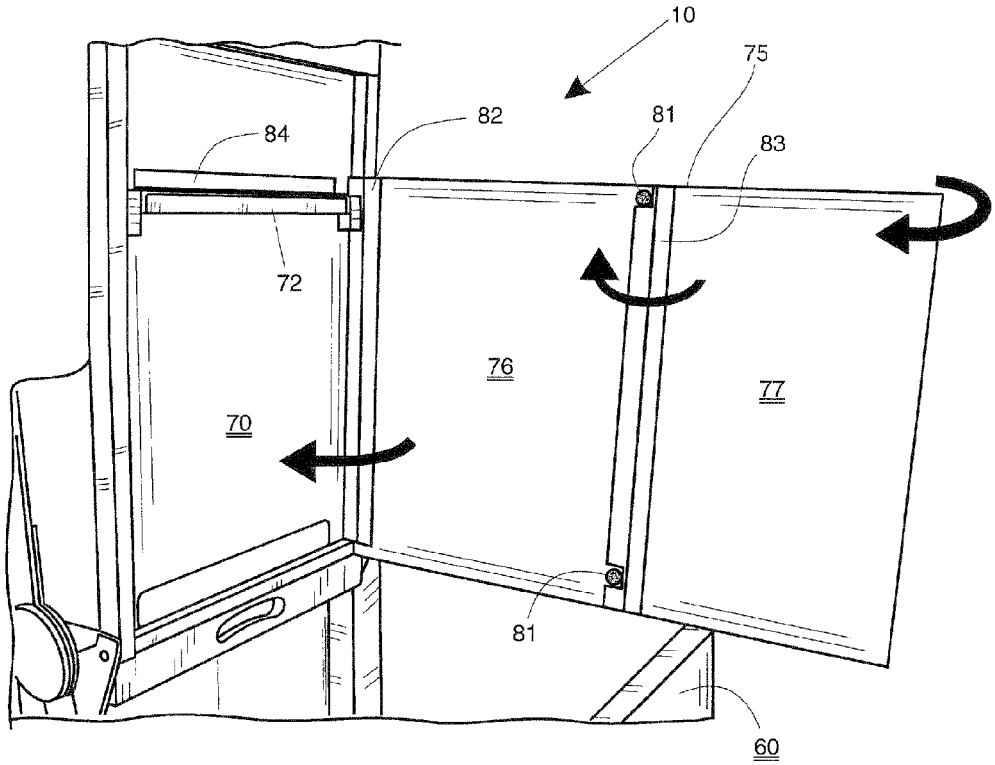
FIG. 9 is a back perspective view of the furniture of FIG. 8, illustrating the manner in which the cover front wall is folded.

Now, reference will be made to FIGS. 7, 8 and 9 together, to describe important features related to the folding movement of the furniture 10. As explained above, the foldable front wall 75 decouples from the side wall 60 and from the shelf 40 by detaching the hook and fiber portions 81. As seen in FIGS. 7 to 9, the foldable front wall 75 is formed by an upper section 76 hingedly attached to the cover 70 by a first plastic hinge 82; the front wall 75 has also a lower section 77 hingedly attached to the upper section 76 by a second plastic hinge 83, which allows a 180° movement of the lower section to contact and to locate itself behind the upper section 76, which due to the first plastic hinge can be housed in the cover 70 covering the transversal profile 72, which, as mentioned above, is hingedly attached to the cover 70. A third plastic hinge 84 is used for this purpose, i.e., the transversal profile 72 has a 90° movement to be stored under the cover due to the third plastic hinge 84. In FIG. 8, it is to be noted that the first and second plastic hinges 82 and 83 are illustrated in dashed lines since they are hidden from the front part of the furniture 10.

Figures 10, 11:
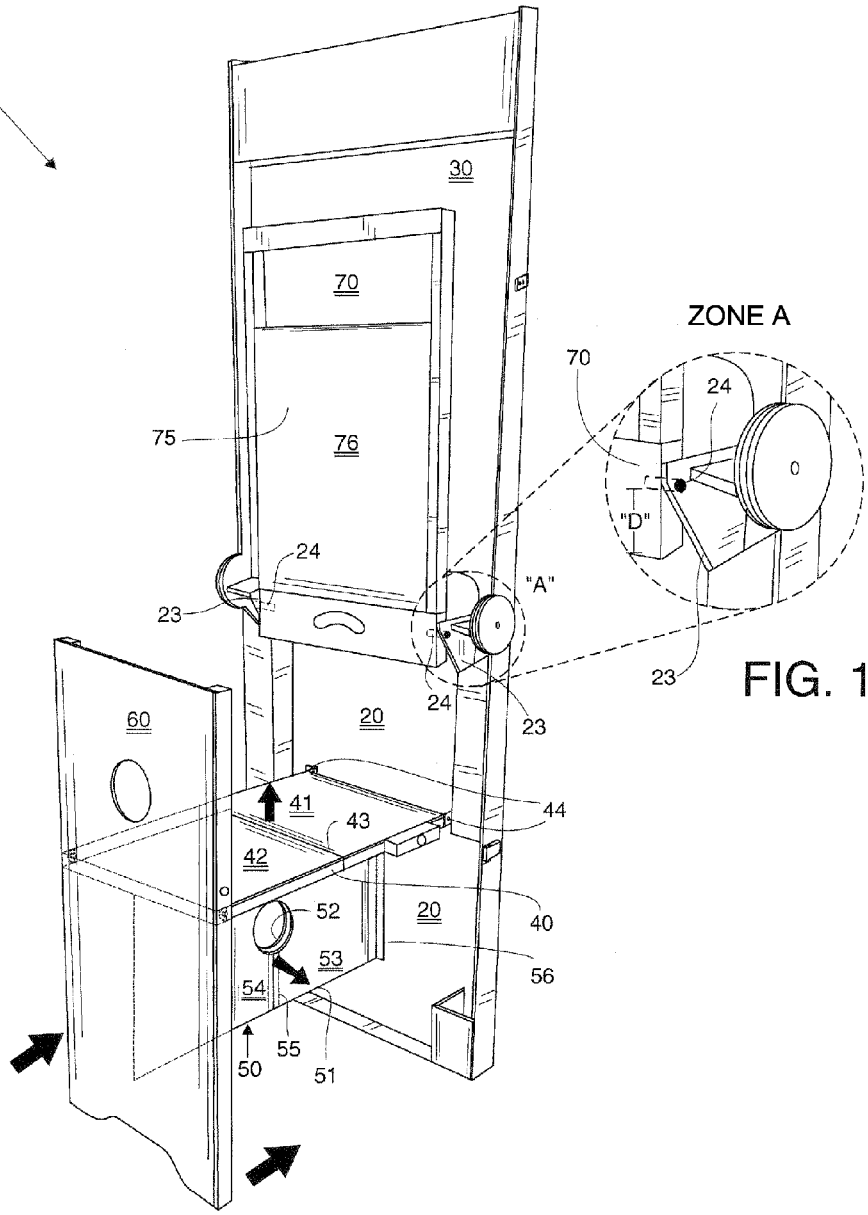
FIG. 10 is a front perspective view of the furniture of FIG. 8 once the cover front wall has been already folded.
FIG. 11 is an enlarged view of zone "A" of FIG. 10 to illustrate the cover and lower wall mounting.

When the front wall 75 is folded and housed inside the cover 70, the position illustrated in FIG. 10 is reached, wherein is seen that the cover 70 is completely lifted such that it contacts the upper wall 30. In this regard, it is important to mention that the cover 70 has a wide upward and downward movement greater than 180° since it is hingedly mounted to the lower wall 20. This can be clearly seen in FIG. 11 showing an enlarged view around the encircled zone "A" in FIG. 10. Particularly, the lower wall 20 includes a pair of side supports 23 with a triangle shape vertically oriented and protruding from the lower wall 20. Between said supports 23, the cover 70 is mounted by hinge axis 24 crossing the supports 23 and the cover 70.

A technical important feature to achieve the wide upward and downward movement of the cover 70 is its mounting distance "D" to the side supports 23 from the cover end 70, thereby achieving, when the cover 70 is in a contrary position to that illustrated in FIG. 10, that the cover 70 be separated from the lower wall 20, this being very important to house underneath the cover 70 the other furniture elements when folded, i.e., the cover 70 will cover the side wall 60, the shelf 40 and the support 50.

Figures 12, 13:
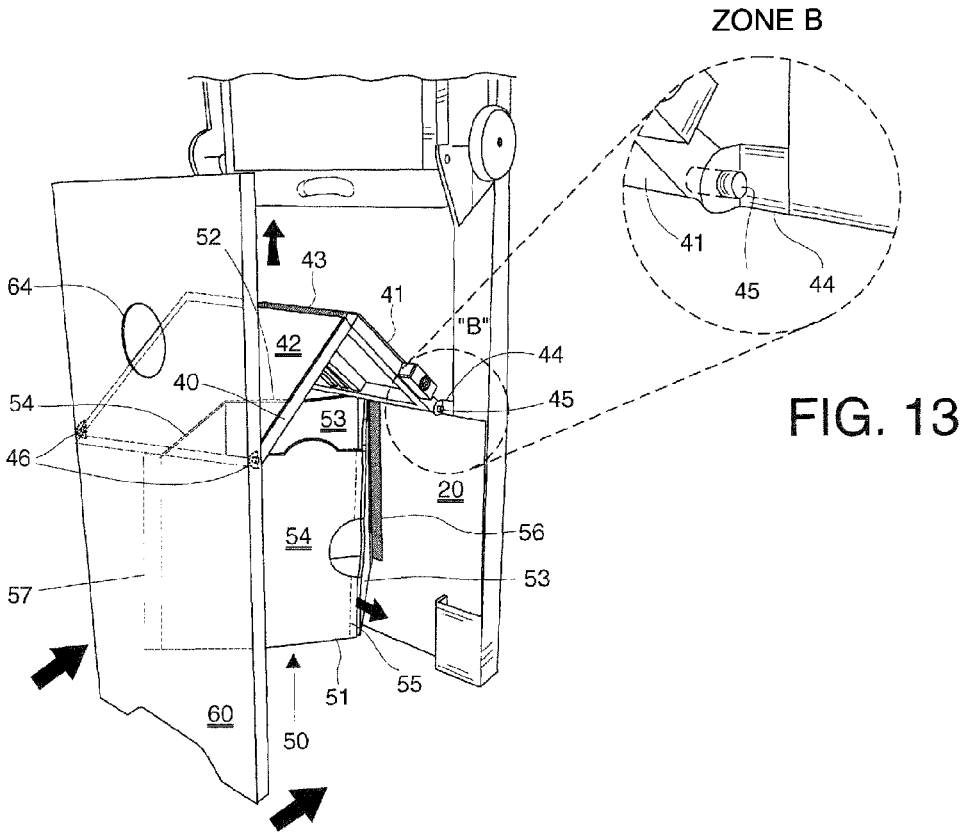
FIG. 12 is a lower part view of the furniture of FIG. 11 to illustrate the shelf and support folding movement.
FIG. 13 is an enlarged view of zone "B" in FIG. 12 to illustrate one shelf half and lower wall mounting.

Now reference is made to FIGS. 10, 12 and 13, to describe the shelf 40 and the foldable support 50 folding; as mentioned, shelf 40 is formed by a first half 41 and by a second half 42 hingedly attached to each other. A fourth plastic hinge 43 is used for this purpose. Said first half 41 is hingedly attached to the lower wall 20 by a first pair of metallic supports 44 including a rotation axis 45 crossing each support and the front or rear flank of the first half 41, i.e., the first half 41 remains trapped between both metallic supports 44. In turn, the second half 42 is hingedly attached to the side wall in a similar manner, i.e., a second pair of metallic supports 46 is used, including an axis crossing the front or rear flank of the second half 42 of the shelf 40. The second pair of supports is illustrated in dashed lines in FIG. 12 only.

On the other hand, the foldable support 50 comprises: a foldable front vertical wall 51; and, a foldable rear vertical wall 52, both vertical walls 51 and 52 have the same structure and keep a mirror relation therebetween. Each vertical wall 51 or 52 comprises a first section 53 and a second section 54 hingedly attached to each other by a fourth plastic hinge 55 arranged in vertical position and illustrated in dashed lines, wherein the first section 53 of each vertical wall 51 or 52 is hingedly attached in vertical position to the lower wall 20 by a fifth plastic hinge 56, and the second section 54 is hingedly attached to the side wall 60 by a sixth plastic hinge 57. Each half 41 and 42 of the shelf 40 are constructed by a frame and a plate covering the frame. In turn, each support wall section 51 and 52 is formed preferably by a single plate made from foamed PVC.

Figure 14:
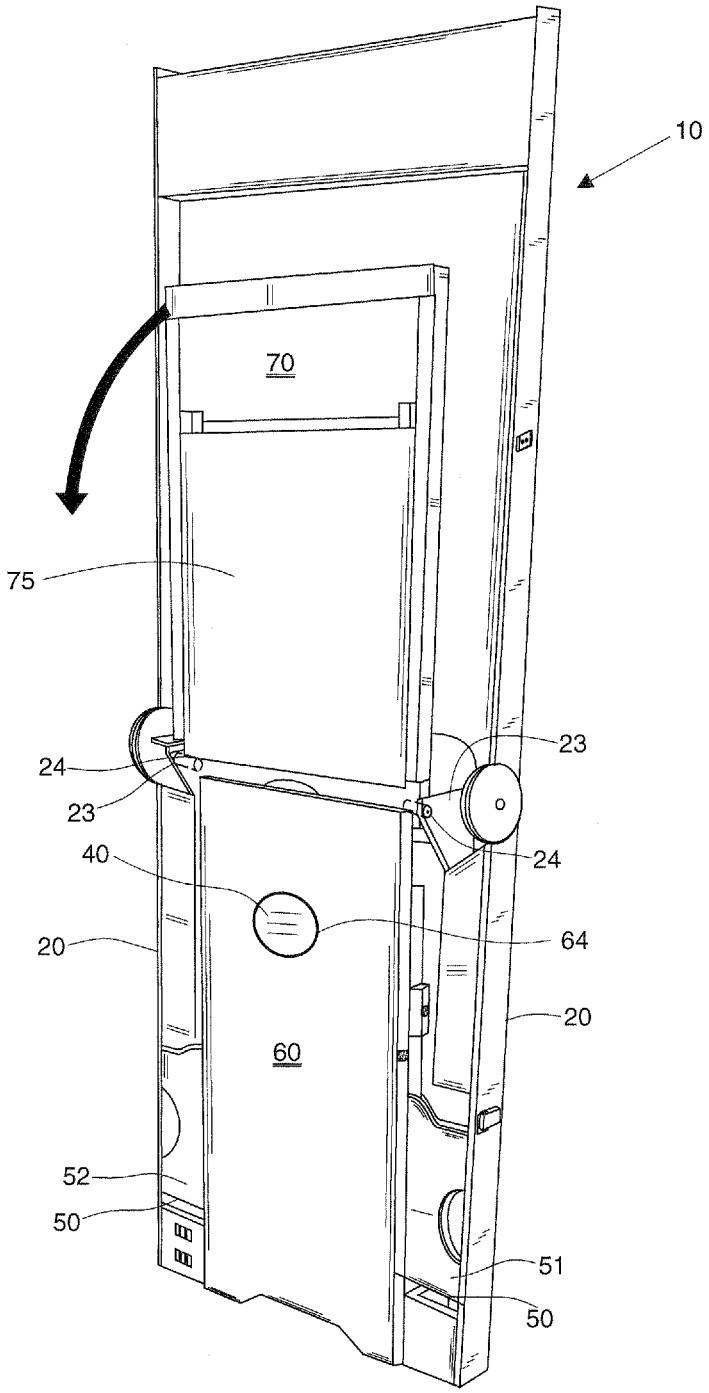
FIG. 14 is a front perspective view of the furniture of FIG. 12 once the shelf and support have been folded and covered by the side wall.

With the described structure for the shelf 40 and support 50, when approaching the side wall 60 to the lower wall 20, the halves 41 and 42 of the shelf 40 raises up in the fourth plastic hinge 43 zone to be folded and remain one next to the other; while the front and rear vertical walls 51 and 52 of the foldable support 50 are folded outwardly the furniture at the sections 53 and 54 joining zone by means of the fourth plastic hinge 55, remaining one next to the other and occupying the space between the lower wall 20 side faces. In this manner, the side wall 60 covers both the shelf 40 and the front and rear walls 51 and 52 of the lower support as illustrated in FIG. 14. The side wall 60 includes at least one opening for the hand 64, such that when unfolding the furniture 10, said lateral wall 60 is gripped to move it away from the place it has been housed.

Figure 15:
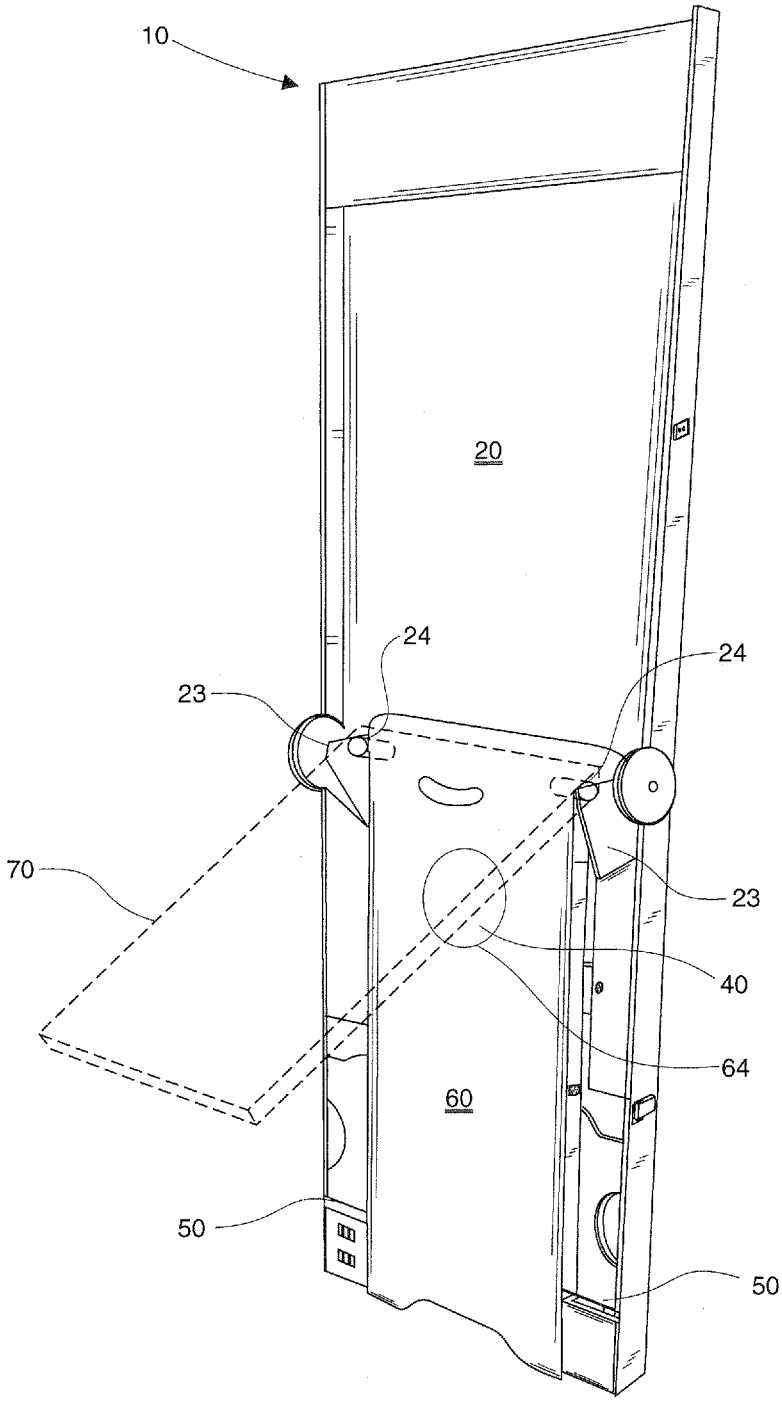
FIG. 15 is a front perspective view of the furniture of FIG. 13 during the cover downwards movement.
Figure 16:
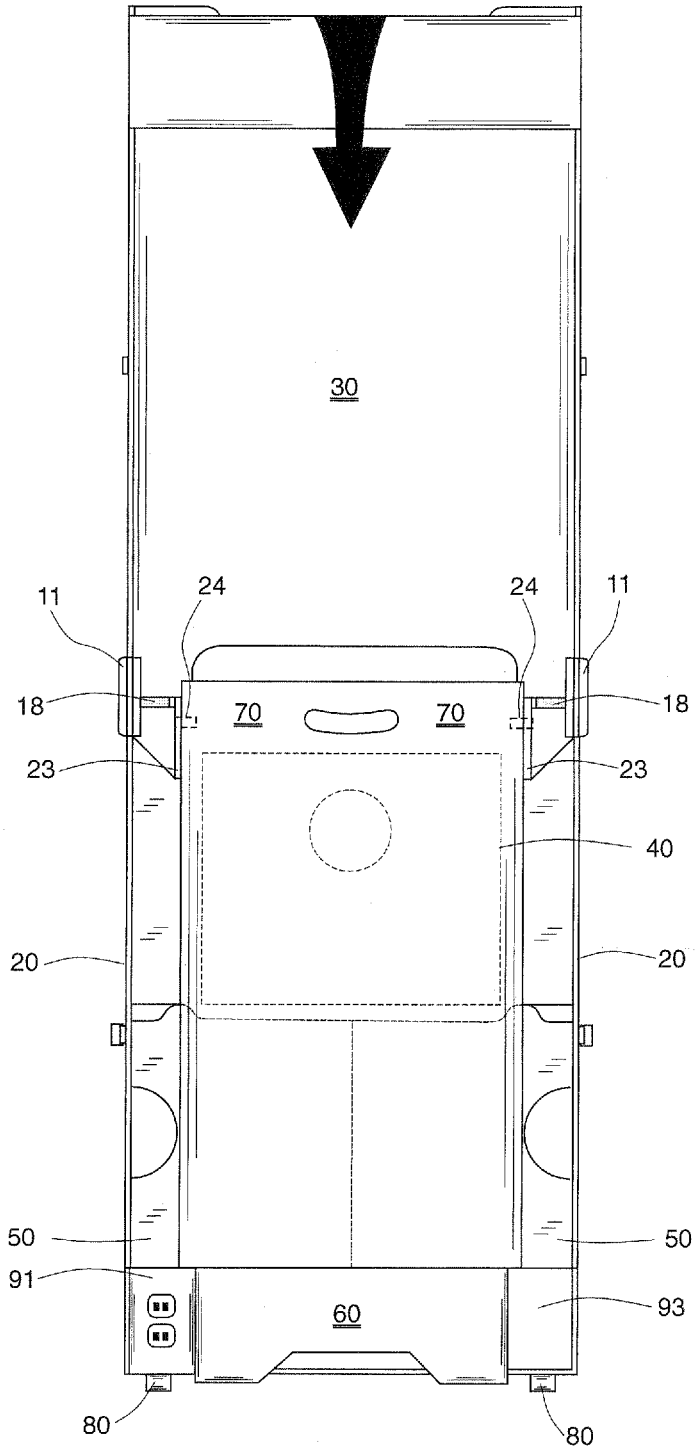
FIG. 16 is a right side view of the furniture of FIG. 15 once the cover has been lowered to cover the side wall.

With reference to FIGS. 14, 15 and 16, the cover 70 is lowered because it is hingedly attached to the side supports 23 of the rear wall 20 by means of the hinge axis 24, once the cover 70 downwards movement is completed, this covers the side wall 60 and the elements already below thereof, i.e., the shelf and the foldable support to achieve the position illustrated in FIG. 16, wherein the socket 90 and the compartment 91 can be appreciated. The stability of the furniture 10 when folding is maintained since the furniture 10 supports on the casters 80 and on the side wall 60 lower part, further the upper wall 30 cannot move due to the hinges 11 being locked by the pins 18.

Figure 17:
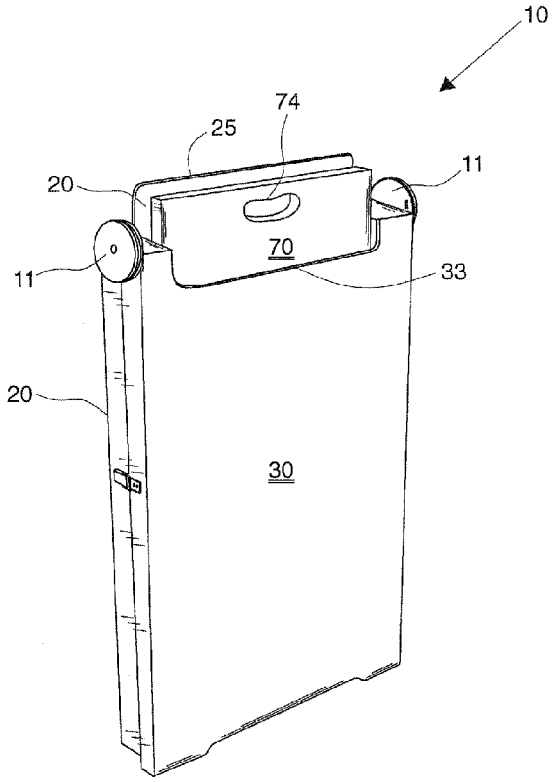
FIG. 17 is a perspective view of the furniture of FIG. 1 in its "folded" position.
Figure 18:
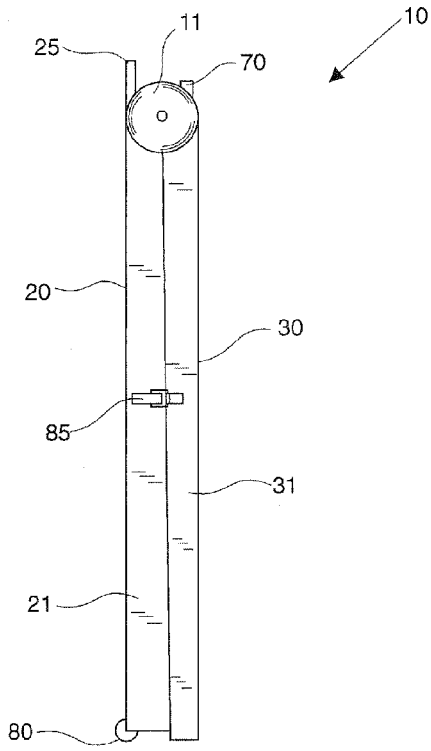
FIG. 18 is a side view of the furniture of FIG. 17.

With regard to the above, when removing the pins 18 from the locking position the hinges 11 are released, thereby allowing the upper wall 30 to descend and close over the lower wall 20 thereby achieving the furniture folded position illustrated in FIG. 17, wherein is seen that the cover 70 protrudes because the upper wall includes a cut 33 at its edge; said cut 33 contacts the lower wall 20 particularly in a protrusion 25 coupled to the cut 33 when the furniture 10 is at the upright position. The lower wall cut 33 is important since the cover 70 protrudes form a flank thereof, which includes a handle 74 integrally formed therein, the handle 74 protrudes from the exhibition furniture when folded. As shown, the handle 74 is specifically an opening included at the cover 70 surface, the furniture may be gripped by said handle 74 to lean it and pull it through the floor supported on the casters 80 noted in FIG. 18, wherein a side view of the furniture 10 in the collapsed position is shown, where it is clearly seen how the lower wall 20 and the upper wall 30 form a housing when their side faces edges 21 and 31 are in contact. At the side view of FIG. 18, again the cover 70 protruding from the furniture 10 can be seen, further, is seen the lower wall 20 and the upper wall 30 including external locking means to keep the exhibition furniture 10 in this position, said locking means are the padlocks 85 widely known in the art, latches or locks may also be used to keep the lower wall 20 and upper wall 30 in this position.

Figure 19:
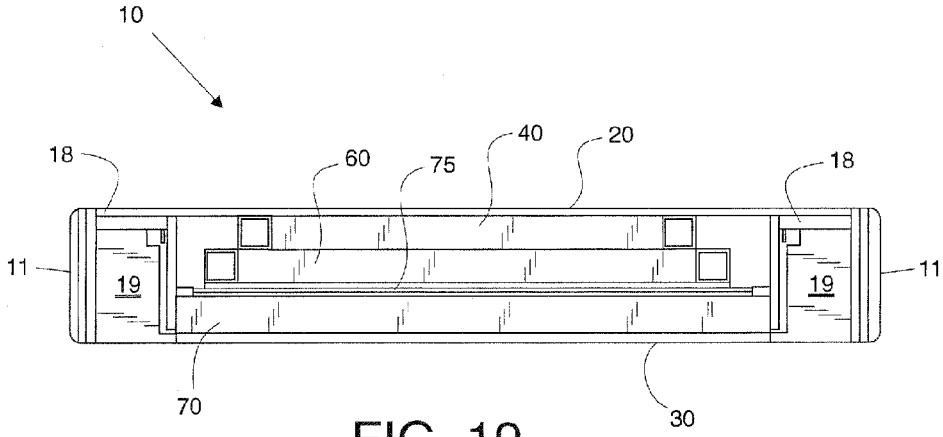
FIG. 19 is an upper plant view of the furniture of FIG. 17.

FIG. 19 shows an upper plant view 10 of the folded furniture 10, wherein it can be appreciated that, between the lower and upper walls 20 and 30, the cover 70, the front wall 75, the side wall 60 and the shelf 40, are located. Further, in this pair of figures the pins 18 with their safety plates 19 and the hinges 11 are seen. As shown, the furniture 10 is very compact in this position.

As mentioned above, the construction materials are lightweight, preferably using PVC at most of the parts avoiding as possible the use of metallic parts, however, the PVC is stiff enough and allows working without problems. From another point of view, the structural relationship and connection among the furniture elements are important for the present invention, which in order to be lightweight is preferably made from stiff plastic materials.

According to the above, as seen, the foldable exhibition and working furniture of the present invention has been devised as having great stability when in the upright position and during the whole folding procedure. The upper and lower walls form a housing protecting the elements stored therein; and it will be apparent to any skilled in the art that the above described embodiment is only illustrative, and not limitative of the present invention, since numerous changes are possible for the details without departing from the scope of the invention, as may be the provision or casters, the use of another kind of hinges than those illustrated and described.

Although a preferred embodiment of the invention has been described and exemplified, it should be stressed that numerous modifications may be made thereto. Therefore, the present invention shall not be deemed as limited except for the teachings of the prior art and by the scope of the appended claims.

The invention claimed is:

1. A foldable exhibition and working furniture comprising:

a lower wall;

an upper wall hingedly attached to the lower wall by a pair of hinges that include locking means;

a side wall laterally spaced apart from the lower wall;

a shelf comprising a first half and a second half hingedly attached to each other;

a foldable support contacting the shelf to support it from below;

a cover hingedly attached to the lower wall and detachably joined on the side wall thereby connecting it to the lower wall;

wherein a hinge of the pair of hinges comprises:

a first disk attached to the lower wall and including a first locking groove;

a second disk next to the first disk and attached to the upper wall and including a second locking groove;

a base disk next to the second disk, such that the second disk is between the first disk and the base disk;

a rotation axis crossing the base disk, the first and the second disks, such that the first disk may move around the rotation axis to move the upper wall upwards or downwards on the lower wall supported on the hinge; and wherein the cover includes a foldable front wall hingedly attached thereto such that when the exhibition furniture is in an upright position, the front wall extends from the cover downwards covering the shelf; the front wall being further releasably fixed to the side wall and to the shelf, the front wall folded and housed below the cover.

2. A foldable exhibition and working furniture, according to claim 1, further comprising casters mounted in the lower wall and contacting the floor to move the exhibition furniture when in a folded or the upright position.

3. A foldable exhibition and working furniture, according to claim 1, wherein the foldable front wall comprises an upper section hingedly attached to the cover and a lower section hingedly attached to the upper section, wherein the front wall, the shelf and the side wall comprise hook and fiber cooperating portions to fix the foldable front wall.

4. A foldable exhibition and working furniture, according to claim 1, wherein the pair of hinges connecting the upper and lower walls are laterally opposite to one another.

5. A foldable exhibition and working furniture, according to claim 4, wherein the locking means releasably fixes the upper wall in a vertical position on the lower wall.

6. A foldable exhibition and working furniture, according to claim 5, wherein the locking means is a pin attached to the lower wall and received within the first and the second grooves to avoid the rotation movement of the first disk over the rotation axis, consequently locking the upper wall movement on the lower wall.

7. A foldable exhibition and working furniture, according to claim 1, wherein the cover includes a handle integrally formed therein, the handle protruding from the exhibition furniture when folded.

8. A foldable exhibition and working furniture, according to claim 7, wherein said handle is an opening formed over the cover surface.

9. A foldable exhibition and working furniture, according to claim 1, wherein the foldable support comprises:

a foldable front vertical wall; and a foldable rear vertical wall, each vertical wall comprising a first section and a second section hingedly attached to each other, wherein the first section of each vertical wall is hingedly attached to the lower wall, and the second section is hingedly attached to the side wall to connect the lower wall to the side wall.

10. A foldable exhibition and working furniture, according to claim 1, wherein the lower wall is provided at least with a socket being fed by a cable.

11. A foldable exhibition and working furniture, according to claim 10, wherein the lower wall has a compartment to store the cable feeding the socket.

12. A foldable exhibition and working furniture, according to claim 1, wherein the upper wall includes a board wherein graphic material is exposed.

13. A foldable exhibition and working furniture, according to claim 1, wherein the lower wall and the upper wall include external locking means allowing to keep folded the exhibition furniture.

14. A foldable exhibition and working furniture, according to claim 13, wherein the external locking means is a padlock.

15. A foldable exhibition and working furniture, according to claim 1, wherein the side wall includes at least an opening such that, when unfolding the exhibition furniture, said side wall is adapted to be gripped to move it away from the place it has been housed.

16. A foldable exhibition and working furniture, according to claim 1, wherein the cover includes a coupling received inside the side wall.

17. A foldable exhibition and working furniture, according to claim 16, wherein the coupling comprises a transversal profile hingedly attached to the cover, the transversal profile having two ends, and a pair of coupling projections attached to the ends of the transversal profile and received in the side wall.

18. A foldable exhibition and working furniture, according to claim 17, wherein the side wall comprises a profile having upper openings to receive the coupling projections.

* * * * *